US007488962B2

(12) United States Patent
Korobochko et al.

(10) Patent No.: US 7,488,962 B2
(45) Date of Patent: Feb. 10, 2009

(54) ARRANGEMENT FOR THE GENERATION OF INTENSIVE SHORT-WAVELENGTH RADIATION BASED ON A GAS DISCHARGE PLASMA

(75) Inventors: Vladimir Korobochko, Goettingen (DE); Alexander Keller, Goettingen (DE); Juergen Kleinschmidt, Goettingen (DE)

(73) Assignee: XTREME technologies GmbH, Jena (DE)

( * ) Notice: Subject to any disclaimer, the term of this patent is extended or adjusted under 35 U.S.C. 154(b) by 261 days.

(21) Appl. No.: 11/421,144

(22) Filed: May 31, 2006

(65) Prior Publication Data

US 2006/0273732 A1 Dec. 7, 2006

(30) Foreign Application Priority Data

Jun. 1, 2005 (DE) ..... 10 2005 025 624

(51) Int. Cl.
*G21K 5/02* (2006.01)

(52) U.S. Cl. ..... 250/504 R; 250/493.1

(58) Field of Classification Search ..... 250/504 R, 250/493.1; 315/111.21; 378/119
See application file for complete search history.

(56) References Cited

U.S. PATENT DOCUMENTS 6,414,438 B1 7/2002 Borisov et al.
6,815,900 B2 * 11/2004 Ahmad et al. ..... 315/11.21
6,894,298 B2 * 5/2005 Ahmad et al. ..... 250/504 R
7,291,853 B2 * 11/2007 Fomenkov et al. ..... 250/504 R
2004/0071267 A1 4/2004 Jacob et al.

FOREIGN PATENT DOCUMENTS

| | | |
|---|---|---|
| DE | 101 51 080 | 12/2002 |
| DE | 102 60 458 | 12/2002 |
| WO | 02/082871 | 10/2002 |
| WO | 02/082872 | 10/2002 |
| WO | 03/087867 | 10/2003 |
| WO | 2004/019662 | 3/2004 |

* cited by examiner

*Primary Examiner*—Kiet T Nguyen
(74) *Attorney, Agent, or Firm*—Reed Smith LLP

(57) ABSTRACT

The invention is directed to an arrangement for the generation of intensive short-wavelength radiation based on a gas discharge plasma. It is the object of the invention to find a novel possibility for generating intensive short-wavelength radiation, particularly EUV radiation, based on a gas discharge plasma which achieves a long life of the electrode system along with a high total efficiency of the radiation source without substantially increasing the dimensions of the discharge unit. This object is met, according to the invention, in that exclusively suitably shaped vacuum insulation areas which have the shape of an annular gap and which are formed depending on the product of gas pressure (p) and interelectrode distance (d) between the cathode and anode are provided for insulating the cathode and anode from one another in a cylindrically symmetric electrode arrangement for reliable suppression of electron arcing.

35 Claims, 12 Drawing Sheets

ARRANGEMENT FOR THE GENERATION OF INTENSIVE SHORT-WAVELENGTH RADIATION BASED ON A GAS DISCHARGE PLASMA

CROSS-REFERENCE TO RELATED APPLICATION

This application claims priority of German Application No. 10 2005 025 624.4, filed Jun. 1, 2005, the complete disclosure of which is hereby incorporated by reference.

BACKGROUND OF THE INVENTION a) Field of the Invention

The invention is directed to an arrangement for the generation of intensive short-wavelength radiation based on a gas discharge plasma, preferably as a source of EUV radiation. The invention is applied in particular in high-power radiation sources for ELV lithography which requires radiation sources with electrodes having a long life in the process of industrial fabrication of semiconductor chips.

b) Description of the Related Art

In semiconductor technology, there is a continuing trend toward increasingly smaller structures, and radiation with increasingly shorter wavelengths is required for lithographic generation of these structures. At present, EUV radiation sources, viewed as the most promising lithographic tool, are being developed. Basically, there are two different ways of generating the radiating plasma: by laser (LPP) and by gas discharge (GDPP).

Various arrangements are known from the prior art relating to gas discharge-based EUV radiation sources, namely, Z-pinch, plasma focus, star pinch, hollow-cathode discharge arrangements, and capillary discharge arrangements. Further, there are variations in the above-named discharge types (e.g., hypocycloidal pinch discharge) and arrangements that combine elements of different discharge types. In all of these arrangements, a pulsed high-power discharge of >10 kA is ignited in a gas of determined density, and a very hot (kT>30 eV), dense plasma is formed locally as a result of the magnetic forces and dissipated power in the ionized gas.

However, the radiation sources must satisfy precisely defined requirements for use in EUV lithography under production conditions:

| | |
|---|---|
| 1. wavelength | 13.5 nm ± 1% |
| 2. radiation output in the intermediate focus | 115 W |
| 3. repetition frequency | 7-10 kHz |
| 4. Dose stability (averaged over 50 pulses) | 0.3% |
| 5. life of the collector optics | 6 months |
| 6. life of the electrode system | 6 months. |

It is standard for high-power EUV gas discharge sources of the type mentioned above to have a special ceramic disk or cylinder as an insulator between the electrodes. For example, U.S. Pat. No. 6,414,438 B1 discloses a method and arrangement by which short-wavelength radiation is generated from a gas-discharge plasma in that a pre-ionization of the work gas takes place between coaxial electrodes as a sliding discharge on ceramic surfaces which emits UV radiation and fast electrons, and the ionized gas is conducted through an axial aperture of one of the electrodes in the gas discharge area, where it ignites the main discharge.

WO 03/087867 A1 discloses another high-energy photon source that generates EUV radiation in the range of 12-14 nm.

In order to limit erosion of the electrodes, particularly of the center electrode and, therefore, to increase the lifetime of the electrodes, cylindrical insulators are arranged at the side walls of the center electrode so that the discharge current after pinch ignition is shifted over a larger area to another portion of the electrode. It is described as particularly advantageous that the center electrode is covered on the inner side and outer side with insulating tubing.

DE 101 51 080 C1 describes similar tubular insulator configurations that are also added to the inner wall of the outer electrode. Further, different materials are also indicated for this purpose. It is evident that while all of these insulator tubes limit the erosion of the electrodes to determined surface zones, the lifetime of the insulator/electrode configurations is appreciably shortened through cracking and metallization, particularly with high pulse repetition frequencies of the EUV gas discharge source.

For various reasons, the arrangements mentioned above always only meet the above-mentioned requirements (1-7) in a few respects. This can be explained using the example of star pinch discharge which, in itself, is advantageous. Because of the comparatively large distances between plasma and wall (which represents a severe problem in all of the other arrangements due to the otherwise small dimensions), the star pinch arrangement is characterized by a long electrode lifetime. However, the large dimensions of the star pinch discharges cause a luminous plasma with a length of more than 5 mm. This considerably reduces the efficiency of the collector optics and, therefore, the overall efficiency as a quotient of the output in the intermediate focus and the electric power introduced for the discharge. Electrode configurations which employ additional insulator tubes because of their short distances in order to improve the constant, stable generation of the plasma suffer in principle from premature failure of the insulator.

OBJECT AND SUMMARY OF THE INVENTION

It is the primary object of the invention to find a novel possibility for generating intensive short-wavelength radiation, particularly EUV radiation, based on a gas discharge plasma which achieves a long life of the electrodes along with a high total efficiency of the radiation source without substantially increasing the dimensions of the discharge unit.

In an arrangement for the generation of EUV radiation based on a gas discharge plasma in which a cathode and an anode are arranged in a cylindrically symmetric manner and a pre-ionized work gas is supplied to the cathode end, this object is met, according to the invention, in that exclusively suitably shaped vacuum insulation areas which have the shape of an annular gap and which are formed depending on the product of the gas pressure and the interelectrode distance of the cathode and anode for reliable suppression of electron arcing are provided for insulating the cathode and anode from one another.

A device for pre-ionization of the work gas is advantageously provided within the centrally arranged cathode. The anode is preferably an annular electrode which encloses at least the cathode end with a small interelectrode distance and the discharge chamber.

For pre-ionization of the work gas, a pre-ionization electrode with a projecting tubular insulator is advisably arranged in a centrally symmetric manner inside the cathode and opens into a cavity of the cathode. A surface sliding discharge can be generated at the insulator by a pre-ionization pulse between the pre-ionization electrode and the cathode so that the work gas which is ionized in this way flows out of the cavity via at least one through-channel at the cathode end into the discharge chamber, where it is converted into dense, hot plasma by a main discharge pulse. In this connection it should be noted that the ceramic insulator of the pre-ionization electrode needed for the surface sliding discharge is subject to comparatively very little electrical stress because the electrical energy that is dissipated per discharge (about 10 mJ) during pre-Ionization is only about one thousandth of the dissipated pulse energy of the main discharge (>10 J).

In a basic variant, only one through-channel is provided coaxial to the axis of symmetry of the discharge space. However, a plurality of uniformly distributed through-channels are directed along an outer conical surface through a common point on the axis of symmetry on an inner surface of the anode. The through-channels can also be combined to form an annular gap.

The cathode end is advisably provided with a rounded electrode collar which projects into the interior of the anode that circles the discharge chamber. The vacuum insulation area located between the anode and cathode is protected against debris particles from the plasma and against electrode consumption by the electrode collar.

Further, it is advantageous that the cathode end inside the electrode collar has a concave shape and is the location where the dense, hot plasma is formed. A pocket hole or a through-hole is advisably incorporated at the center of the concave curvature of the cathode to distribute the ion beam exiting from the plasma to a larger surface.

The cathode advantageously has a small cavity as pre-ionization chamber and long through-channels which are arranged coaxially and shaped in such a way that, at the cathode end in the discharge chamber, primary electrically conducting ionization channels are directed through a common point on the axis of symmetry of the discharge chamber to a surface of the anode. The intersection point determines the preferred location of the luminous plasma.

In another advantageous construction, the cathode has a large cavity and short through-channels. The cavity extends to the vicinity of a concave cathode end, and the through-channels are arranged in such a way that primary electrically conducting ionization channels are directed through a common point on the axis of symmetry of the discharge chamber to a surface of the anode from the ionized work gas flowing into the discharge chamber.

In a first variant, a surface discharge used for the pre-ionization of the work gas is advisably provided at the inner side of the insulator, and the pre-ionization electrode is constructed so as to be shorter than the tubular insulator and with a central gas inlet inside the tubular insulator.

In a second variant, the surface discharge used for the pre-ionization of the work gas is advantageously provided on the outer side of the insulator, and the pre-ionization electrode projecting into the cavity of the cathode is constructed with a central gas inlet and a tubular insulator located on the outer side.

In another variant, the cavity of the cathode is expanded in width and, in the shape of a spherical hood, is provided with short through-channels over the concave cathode end which are directed to a common point of the axis of symmetry.

In another advantageous construction, the cavity of the cathode is shaped so as to taper conically toward the cathode end and is provided directly with the gas inlet and has a circular opening at the concave cathode end. The pre-ionization electrode is inserted coaxially into this opening and leaves open an annular gap to the discharge chamber through which the work gas is directed in the shape of an outer cone surface to a point on the axis of symmetry in primary electrically conducting ionization channels.

In this case, the pre-ionization electrode has a pocket hole at its surface facing the discharge chamber in the axis of symmetry and also advantageously has its own cooling channels.

In another construction having a cavity that tapers conically toward the cathode end and a circular opening of the cathode, the pre-ionization electrode is advantageously snugly inserted into the opening with inner and outer insulators. The pre-ionization electrode has a plurality of gas inlets which are directed to the surface of the anode as through-channels between inner and outer insulators through a common point on the axis of symmetry of the discharge chamber.

In another construction, an auxiliary electrode which is insulated from the cathode is advantageously inserted into the cavity of the cathode. The auxiliary electrode has the cavity provided for the pre-ionization of the work gas, and the pre-ionization electrode with outer insulator is arranged so as to project into the cavity of the auxiliary electrode, and at least one corresponding through-channel is provided in the cathode and auxiliary electrode for the exit of the pre-ionized work gas.

For this purpose, a plurality of corresponding through-channels are advantageously arranged along an outer conical surface, whose tip lies on the axis of symmetry of the discharge chamber, from the cavity to the discharge chamber in the auxiliary electrode and the cathode to form primary ionization channels in the discharge chamber. In addition, the auxiliary electrode is insulated from the cathode end by another cavity.

In order to increase the dielectric strength of the vacuum insulation, particularly with larger interelectrode distances, the vacuum insulation space (which has larger dimensions) has additional means for generating a magnetic field, and the flux lines of the magnetic field are oriented orthogonal to those of the electric field between the anode and cathode.

For this purpose, concentric magnet rings are advantageously arranged inside and outside the vacuum insulation space between which the magnetic field is formed in radial direction. A body is formed at one of the electrodes (e.g., the anode) toward the transition area in order to prevent inhomogeneities in the electric field between the anode and cathode.

In a second embodiment form, concentric magnet rings are arranged inside and outside the vacuum insulation space, around which are formed two opposed, circularly extending magnetic fields, and a body is likewise formed at the inner magnet ring to prevent inhomogeneities in the electric field in the transition area.

In order to generate magnetic fields of suitable strength, the concentric magnet rings are advantageously constructed in the form of a plurality of individual, annularly arranged permanent magnets, preferably NdFeB magnets. However, the concentric magnet rings can also be constructed as a plurality of annularly arranged electromagnets.

In another embodiment form, a pre-ionization unit has through-channels to a transition area between the vacuum insulation space and discharge chamber, and the work gas that is pre-ionized in this way is introduced into the discharge chamber through the narrow transition area of the vacuum insulation between the cathode and anode and is contracted by the main current pulse to form hot, dense plasma.

In another advantageous construction of the invention, gas inlets are arranged at the outer vacuum insulation space which has a large interelectrode distance between the cathode and anode, and the gas pressure and interelectrode distance are adjusted in such a way that a spontaneous ignition can be carried out exclusively on the left-hand branch of the so-called Paschen curve, and the product of gas pressure and interelectrode distance is selected in such a way that the breakdown voltage exceeds a minimum value which depends upon the work gas that is used.

In an advantageous manner, grooves or similar structures are additionally incorporated in the outer vacuum insulation space in at least one of the oppositely located electrode surfaces of the cathode and anode for locally increasing the interelectrode distance for the purpose of a local increase in the product of gas pressure and interelectrode distance and to initiate the spontaneous ignition in a plurality of primary ionization channels.

In all of the preceding constructions of the invention, it is advantageous when at least the cathode and anode are outfitted with cooling channels for cooling. In arrangements in which additional auxiliary electrodes are provided for pre-ionization of the work gas, these auxiliary electrodes are also provided with cooling channels in an advantageous manner, at least when they extend directly up to the discharge chamber. Deionized water is preferably used as coolant.

The arrangements for gas discharge-pumped generation of radiation in the range of 13.5 nm advantageously use xenon, lithium vapor or tin vapor, or gaseous tin compounds as work gas.

The basic idea of the invention stems from the consideration that the lifetime of the electrode system of a radiation source based on gas discharge cannot be significantly increased by ceramic insulators which, while limiting the electrode consumption to certain areas, form cracks within a relatively short time due to the high thermal loading or acquire conductive surfaces because they are spattered by eroded electrode material so that the electrode system must be exchanged. Based on this fact, the invention provides a vacuum insulation of the electrodes; however, due to the gas supply lines, suitable pressures and interelectrode distances must be used because the breakdown voltage depends upon the product of the interelectrode distance and pressure level. A number of suitable forms of excitation for generating a pre-ionization in the form of primary (electrically conductive) ionization channels of ionized work gas which are directed into the discharge chamber are described in the following.

The invention makes it possible to provide arrangements for generating intensive short-wavelength radiation, particularly EUV radiation, based on a gas discharge plasma which allow the lifetime of the electrode system to be increased appreciably with a high total efficiency of the radiation source and with comparable dimensions of the discharge unit.

In the following, the invention will be described in more detail.

DESCRIPTION OF THE PREFERRED EMBODIMENTS

Figure 1:
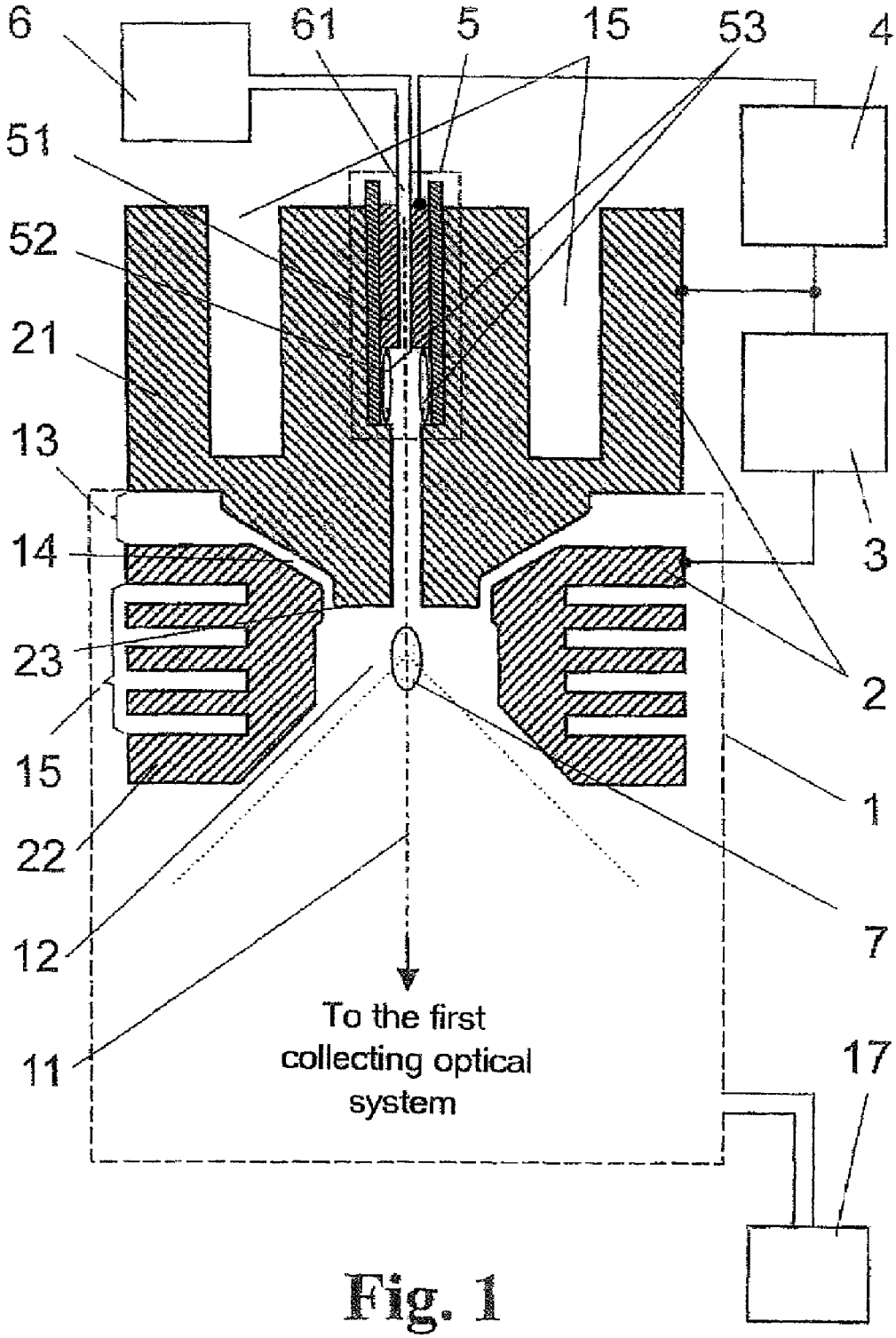
FIG. 1 shows a basic diagram of the arrangement according to the invention.
Figure 2:
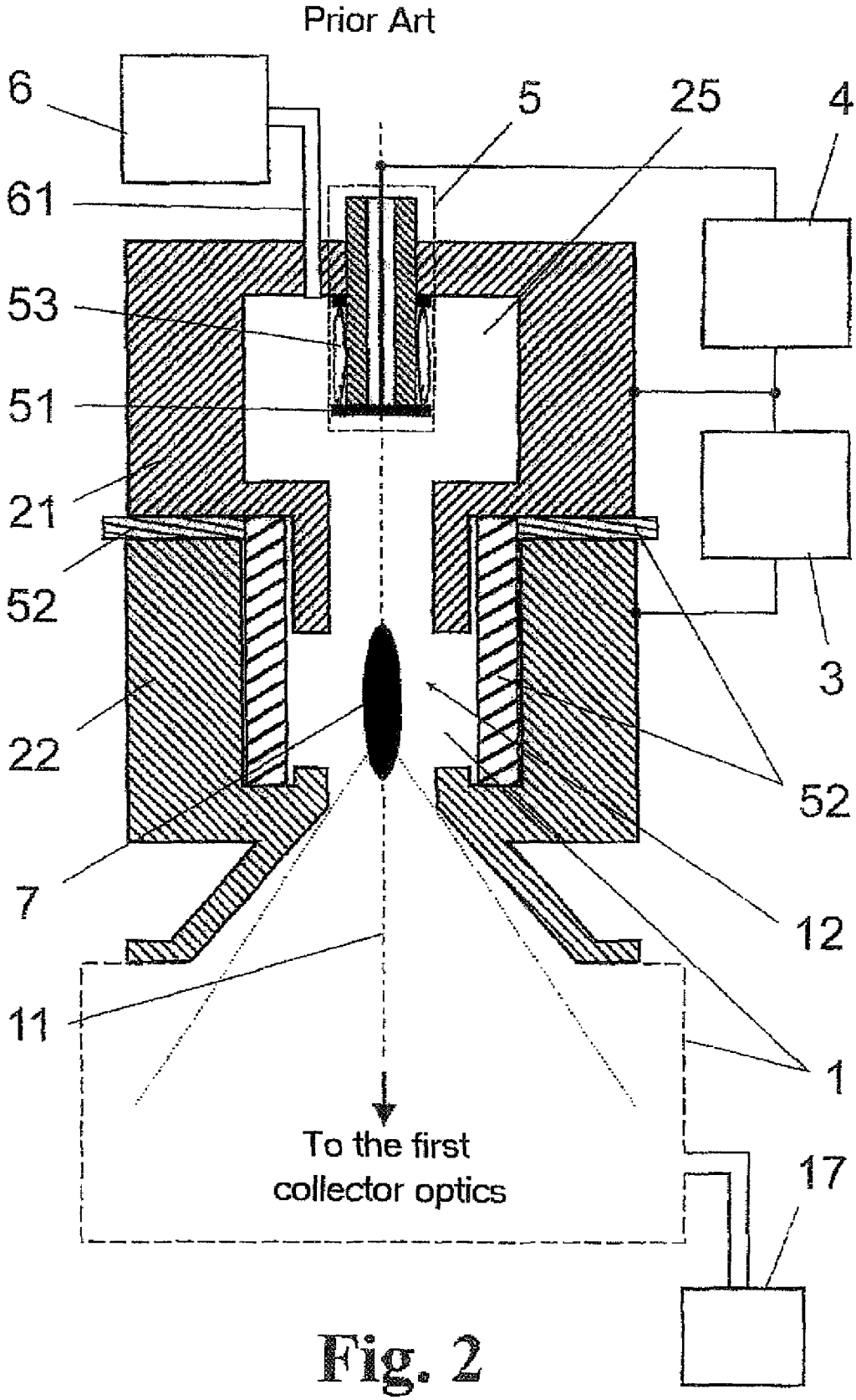
FIG. 2 shows the prior art.

As is shown in FIG. 1, the basic arrangement according to the invention contains a discharge chamber 1 which is formed by the main electrodes 2 (cathode 21 and anode 22) and a cooling jacket 15 through which a suitable coolant flows, a main pulse generator 3 for the high-voltage gas discharge, which main pulse generator 3 is connected to the main electrodes 2, a pre-ionization pulse generator 4 for pre-ionization (for initiating the main discharge) which is connected between a pre-ionization electrode 51 and one of the main electrodes 2 (cathode 21 or anode 22 depending on the polarity of the main pulse generator 3), and a gas supply unit 6 for supplying work gas to the vacuum chamber 1. The main pulse generator 3 has a low-inductance discharge circuit (not shown) which is constructed in such a way that the polarity at the cathode 21 and anode 22 can easily be changed.

According to the invention, the insulation between the cathode 21 and anode 22 is achieved exclusively by an evacuated transition 14 which is arranged between the discharge space 12 and the vacuum insulation space 13 and is shaped as an outer surface of a cone. An interelectrode distance of <1 mm is adjusted in the transition area 14.

Particles resulting from electrode consumption are prevented as far as possible from entering the evacuated zone leading up to the vacuum insulation space 13 by means of at least one rounded electrode collar 23 of the center electrode (cathode 21 or anode 22) which is rounded with a large radius in the discharge chamber 12 before the conical transition area 14. This prevents excessive field strengths at the edges. The outer electrode (anode 22 or cathode 21, depending on polarity) preferably also has rounded edges.

The cathode 21 and anode 22 each contain at least one opening. The opening in the cathode 21 makes it possible for UV radiation, high-energy ions and electrons formed by the sliding discharge 53 (pre-ionization process), as well as other work gases, to enter the discharge space 12, and the opening in the anode 22 forms a free solid angle for the outlet of the desired EUV radiation.

The entire vacuum chamber 1 with the electrode configuration is constructed in a cylindrically symmetric manner with reference to an axis of symmetry 11 (of an axis arranged within the drawing plane).

The current fed through the main pulse generator 2 generates a very hot (kT>30 eV) and dense plasma 7 through resistance heating and through magnetic forces. This plasma 7 emits radiation in the desired spectral region (e.g., EUV region between 12.5 nm and 14 nm).

The pre-ionization pulse generator 4 and the pre-ionization electrode 51 and a main electrode 2 (preferably cathode 21) can be used with any desired shapes of electrode analogous to the following examples. Xenon, tin vapor or lithium vapor, or gaseous tin compounds and lithium compounds can be used as work gas in all cases. Further, buffer gases are advisably mixed in to increase the efficiency of EUV radiation production on one hand and to achieve an advantageous deceleration of the fast particles from the plasma 7 on the other hand so as to improve the protection of the first collecting optics (not shown).

After applying a pre-ionization voltage supplied by the pre-ionization pulse generator 4 to the pre-ionization electrode 51 and the cathode 21 for pre-ionization (for initiating the main discharge), a surface sliding discharge 53 takes place via a tubular ceramic insulator 52. The surface discharge 53 is located on the inner side of the cylindrical insulator 52. It generates high-intensity electron radiation, UV radiation, and x-ray radiation which pre-ionizes the gas in a through-channel 24 of the cathode 21 and transforms it into a conductive pre-plasma in the discharge chamber 12.

The conductive pre-plasma formed in the discharge chamber 12 is heated to the required temperature kT>30 eV during the main discharge by magnetic compression and forms luminous plasma 7.

Total electrode insulation is ensured by the evacuated conical transition area 14 (pressure p<15 Pa, interelectrode distance d>0.5 mm) between the discharge chamber 12 and vacuum insulation space 13.

The rounded electrode collar 23 of the cathode 21 prevents excessive field strength at sharp edges due to its shape and prevents sputter particles of the cathode 21 from entering the evacuated conical transition 14 and the vacuum insulation space 13 of the vacuum insulation from the discharge chamber 12.

In both of the constructions shown in FIG. 2 to FIG. 5, the cathode 21 has a cavity 25. This cavity 25 serves to shape the electric flux lines in a suitable manner particularly in the through-channels 24 to the discharge chamber 12. The through-channels 24 cause primary electrically conducting ionization channels 16 (shown in dashed lines), along which the main discharge current flows, to be formed in the discharge chamber 12. In contrast to conventional hollow-cathode arrangements (e.g., according to WO 02/082871 A1 or WO 2004/019662), the connection between the cavity 25 and discharge space 12 is implemented in the present arrangements by means of through-channels 24 (e.g., FIG. 3) or by means of an annular gap 26 (see FIG. 6, for example) which create defined ionization channels 16 for the ignition of the main discharge pulse. These through-channels 24 are arranged on a sufficiently large circular circumference for reducing the thermal load per area unit. The same condition also applies to the shape of an annular gap 26 from the cavity 25 to the discharge chamber 12.

As was described with reference to FIG. 1, the cathode 21 and anode 22 are separated by a vacuum insulation comprising the vacuum insulation space 13 and evacuated transition area 14 leading up to the discharge chamber 12, and the cathode 21 is provided with a rounded electrode collar 23 to prevent eroded electrode material from entering the transition area 14 and vacuum insulation space 13.

Figure 3:
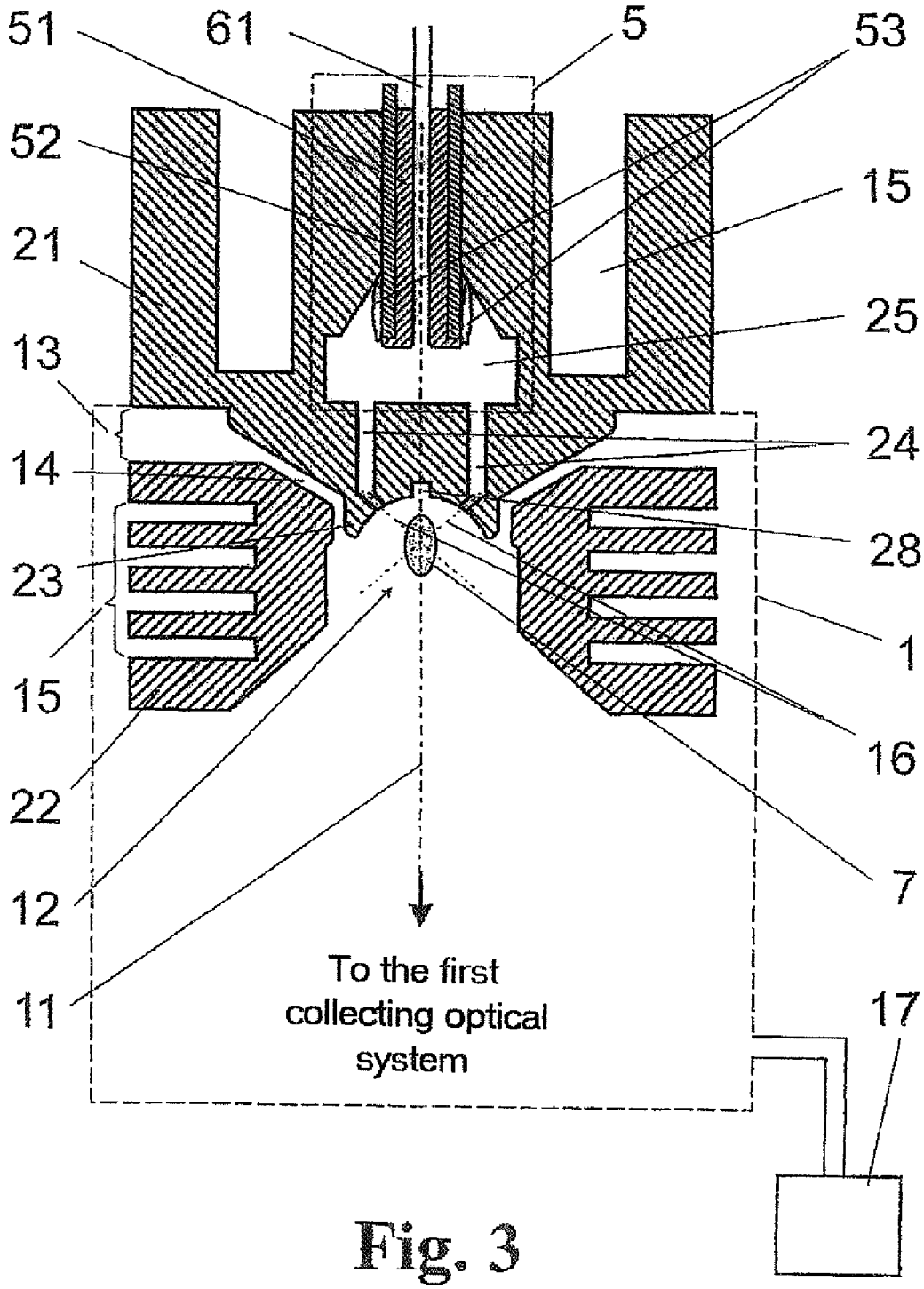
FIG. 3 shows a variant of the invention with a pronounced cathode cavity serving to pre-ionize the work gas and with through-holes to the discharge chamber so that conducting channels which are oriented in a defined manner are formed in the discharge chamber for the main discharge.

FIG. 3 shows a cathode 21 with long through-channels 24 from a relatively small cavity 25 to the discharge chamber 12. After applying the pre-ionization voltage to the pre-ionization electrode 51, a surface discharge 53 (sliding discharge) takes place between the pre-ionization electrode 51 and the cathode 21 on the outer surface of the cylindrical insulator 52. It generates high-intensity electron radiation, UV radiation, and x-ray radiation which pre-ionizes the work gas in the through-channels 24 and the cavity 25. An almost completely ionized pre-plasma is formed in the through-channels 24 during the main discharge. The electron beams which are generated in this way generate primary electrically conducting ionization channels 16 which intersect in the discharge chamber 12 at a point P on the axis of symmetry 11 and are directed to the opposite surface of the anode 22.

During the high-current phase of the main discharge, the current flows through these ionization channels 16 and generates the plasma 7 through heating of the pre-ionized work gas that flows in.

Figure 4:
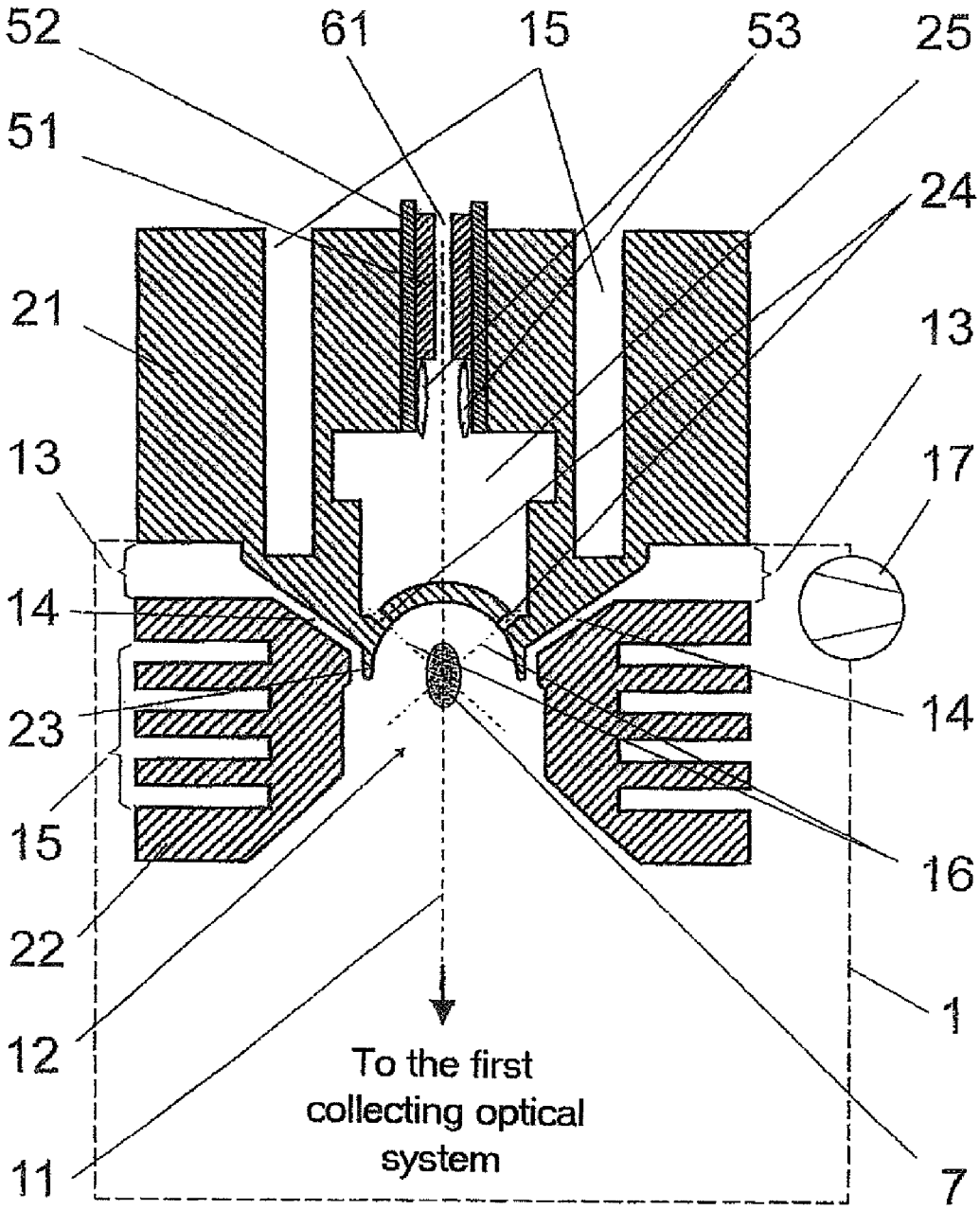
FIG. 4 shows a modified construction with respect to FIG. 3 having an enlarged cathode cavity and shorter through-holes to the discharge space, wherein the surface discharge for pre-ionization is carried out already within the gas feed at the inner side of a ceramic tube.

The drawing in FIG. 4 shows a cathode 21 in the discharge chamber 12 which is outfitted with a small cavity 25 and geometrically short through-channels 24. In contrast to the second embodiment example described above, the surface discharge 53 takes place on the inner side of the cylindrical insulator 52, since the pre-ionization electrode 51 is arranged inside the tubular insulator 52. In other respects, its operation corresponds to that of the second embodiment example.

Figure 5:
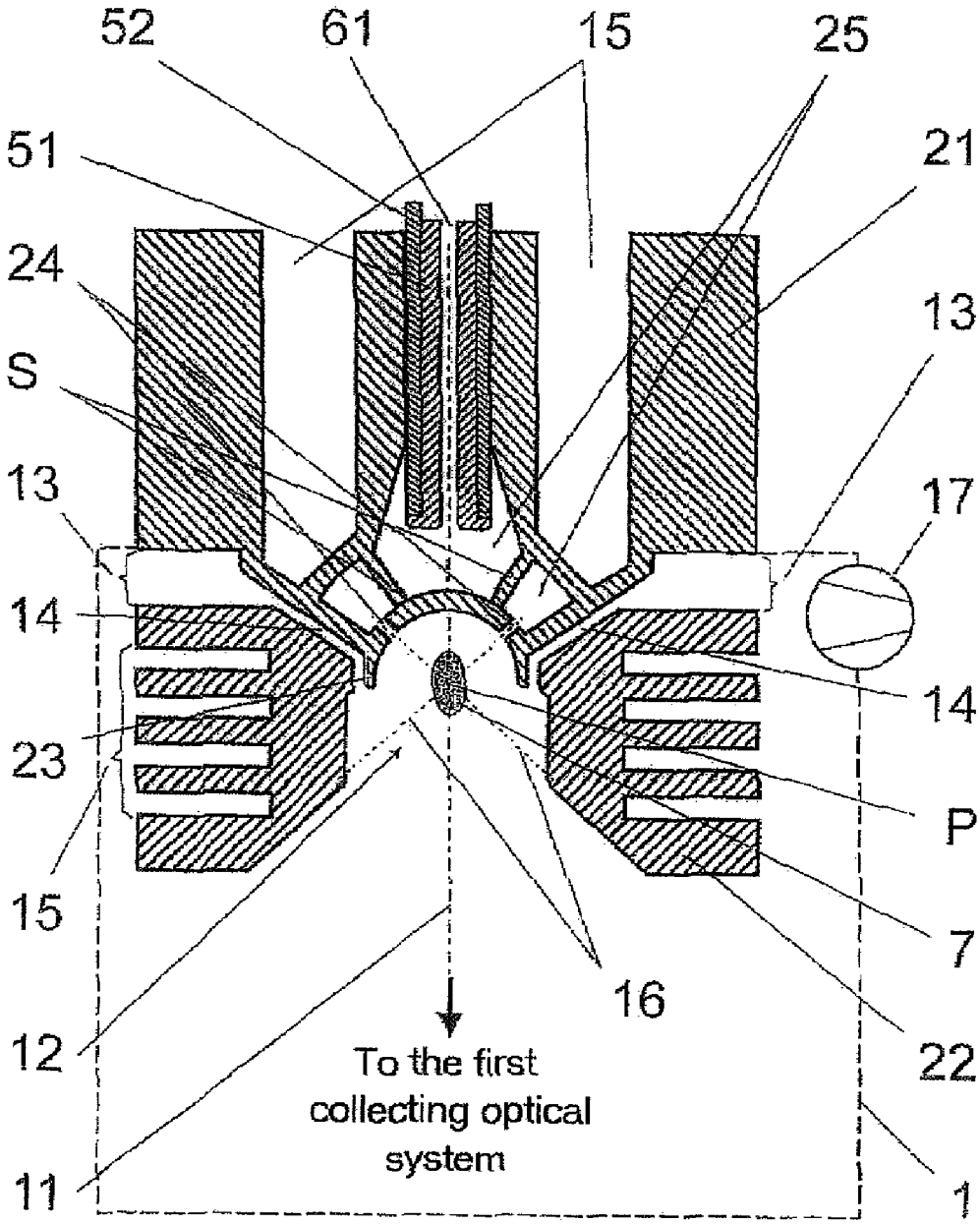
FIG. 5 shows a changed variant with respect to FIG. 3 having a cathode cavity that is specially shaped in a spherically symmetric manner around the center of the discharge space and with very short through-holes to the discharge space.

In the embodiment form according to FIG. 5, the cathode 21 has a larger cavity 25 and a geometrically short annular gap 26 (as a special construction of a plurality of through-channels 24). In this case, webs S are arranged for holding the middle area of the cathode 21 and, at the same time, assist in improving the cooling of the highly thermally loaded central area of the cathode 21. In other respects, the construction and operation correspond to the example according to FIG. 3.

Figure 6:
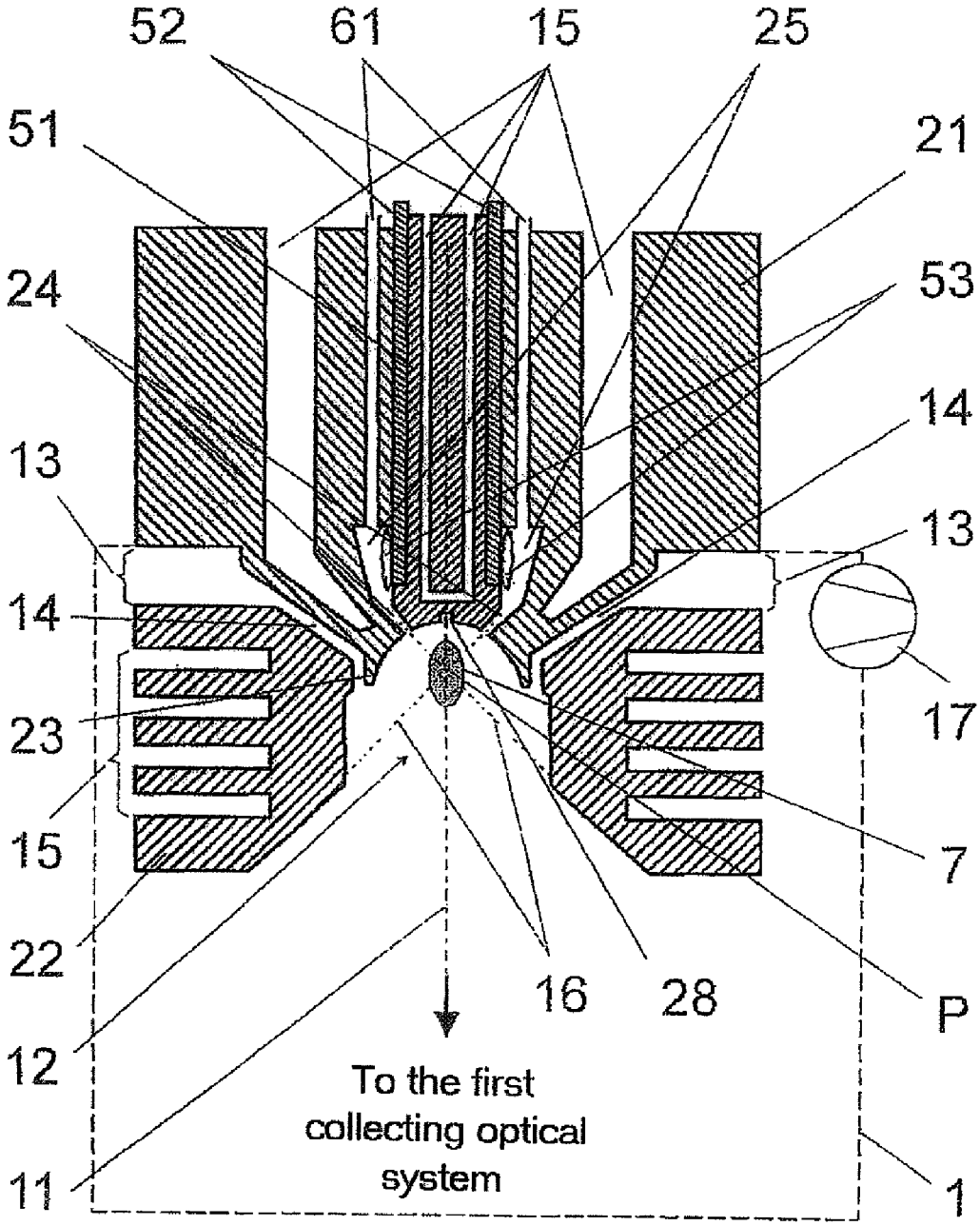
FIG. 6 shows a variant that is appreciably modified from FIG. 3, wherein the cathode cavity is formed as an annular chamber in which the pre-ionization electrode is inserted as a centrally symmetric rod into the cathode cavity, and the through-holes to the discharge space are accordingly transformed into a conical annular gap.

The embodiment example according to FIG. 6 differs from the preceding embodiment examples (FIGS. 3 to 5) in that the connection of the cavity 25 of the cathode 21 to the discharge chamber 12 is formed as an annular gap 26 in such a way that the pre-ionization electrode 51 (with insulator 52) is inserted into a centrally symmetric conical bore hole of the cathode 21 to supplement the curved surface of the cathode 21. Accordingly, due to the rotationally symmetric orientation of the pre-ionization electrode 51 in the bore hole of the cathode 21, the uniform annular gap 26 can be accurately adjusted in any desired manner with respect to its gap width.

The discharge sequence is carried out in exactly the same way as described with reference to FIG. 3 and FIG. 5.

Figure 7:
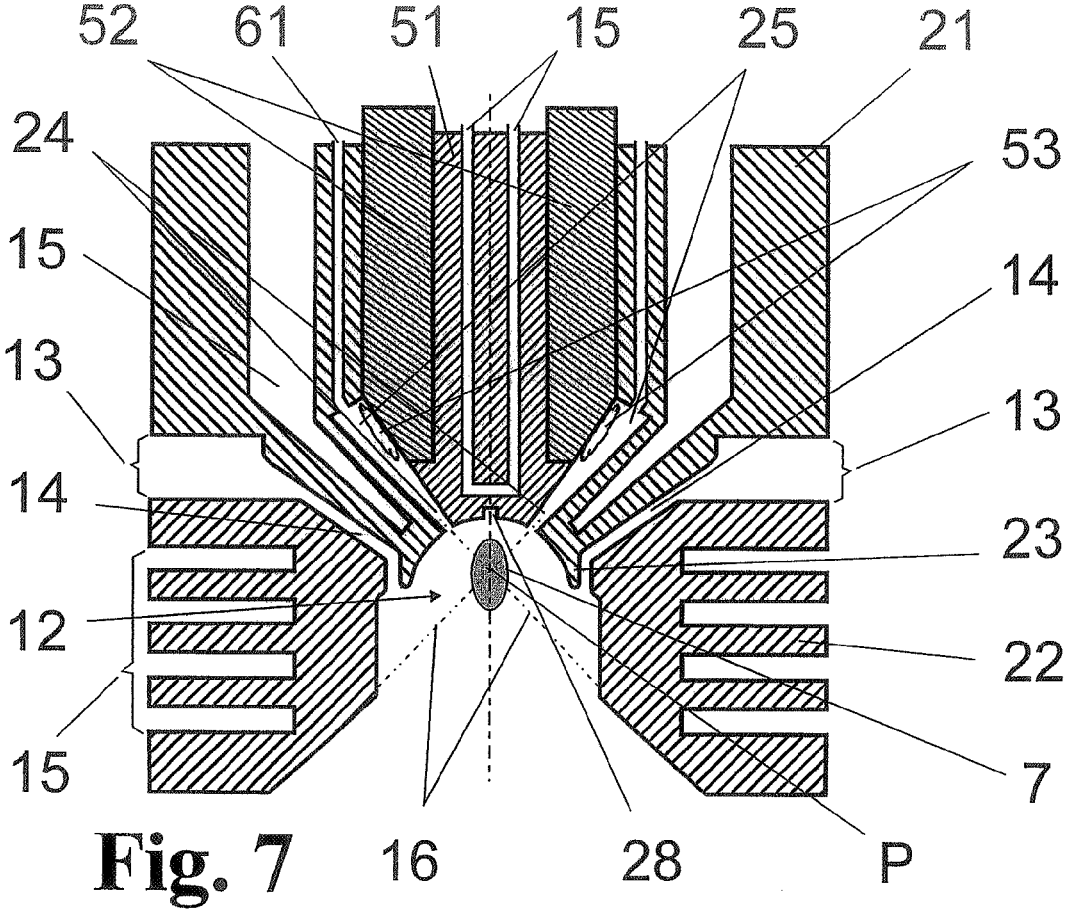
FIG. 7 shows a modification of the construction according to FIG. 6, wherein the pre-ionization electrode with an outer ceramic tube generates a sliding discharge surface which is oriented as an outer cylindrical surface in direct line of sight to the center of the discharge space.
Figure 8:
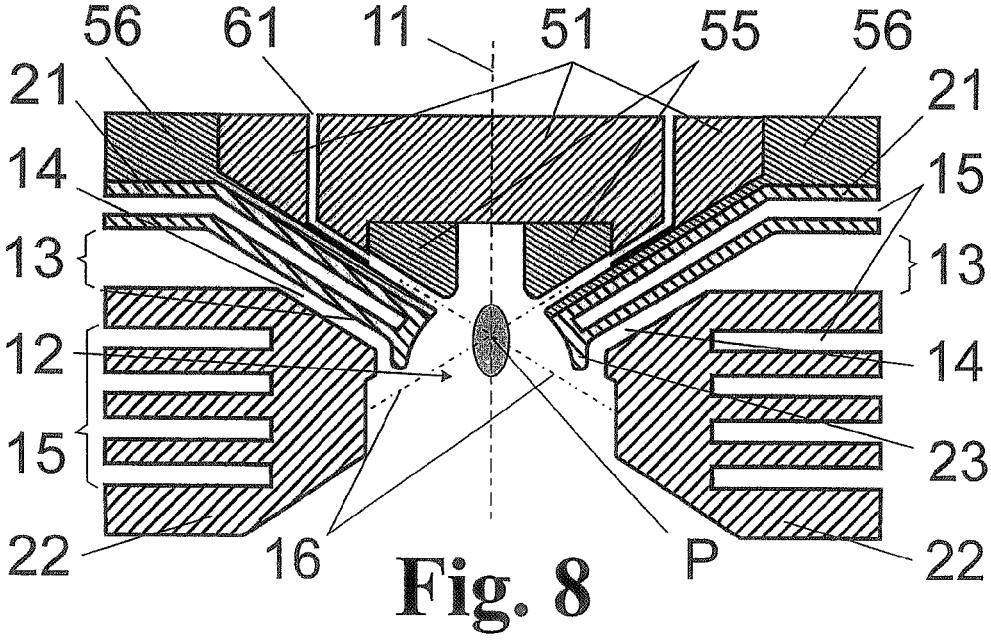
FIG. 8 shows another modification of the construction in FIG. 6, wherein the pre-ionization electrode has a ceramic part with through-channels to the discharge space, the sliding discharge taking place along the surfaces of the thorough-channels in "visual contact" with the center of the discharge space.

FIG. 7 and FIG. 8 refer to arrangements in which the surface discharge 53 (and the resulting electron beams) is made use of directly for generating primary ionization channels 16 in the discharge chamber 12 between the pre-ionization electrode 51 and the cathode 21 via the insulator 52. For this purpose, it is necessary for the discharge chamber 12 to have "visual contact" with the surface discharge 53 at the insulator 52. This means that the surface tangent of the insulator 52 must face the common point P. FIG. 8 has the distinction that the through-channels 24 are formed by inner and outer insulators 56 and 55, respectively, while the gas inlets 61 which are arranged individually in the pre-ionization electrode 51 are introduced directly in the ceramic through-channels 24 in order to generate the surface discharge 53 toward the cathode 21.

Figure 9:
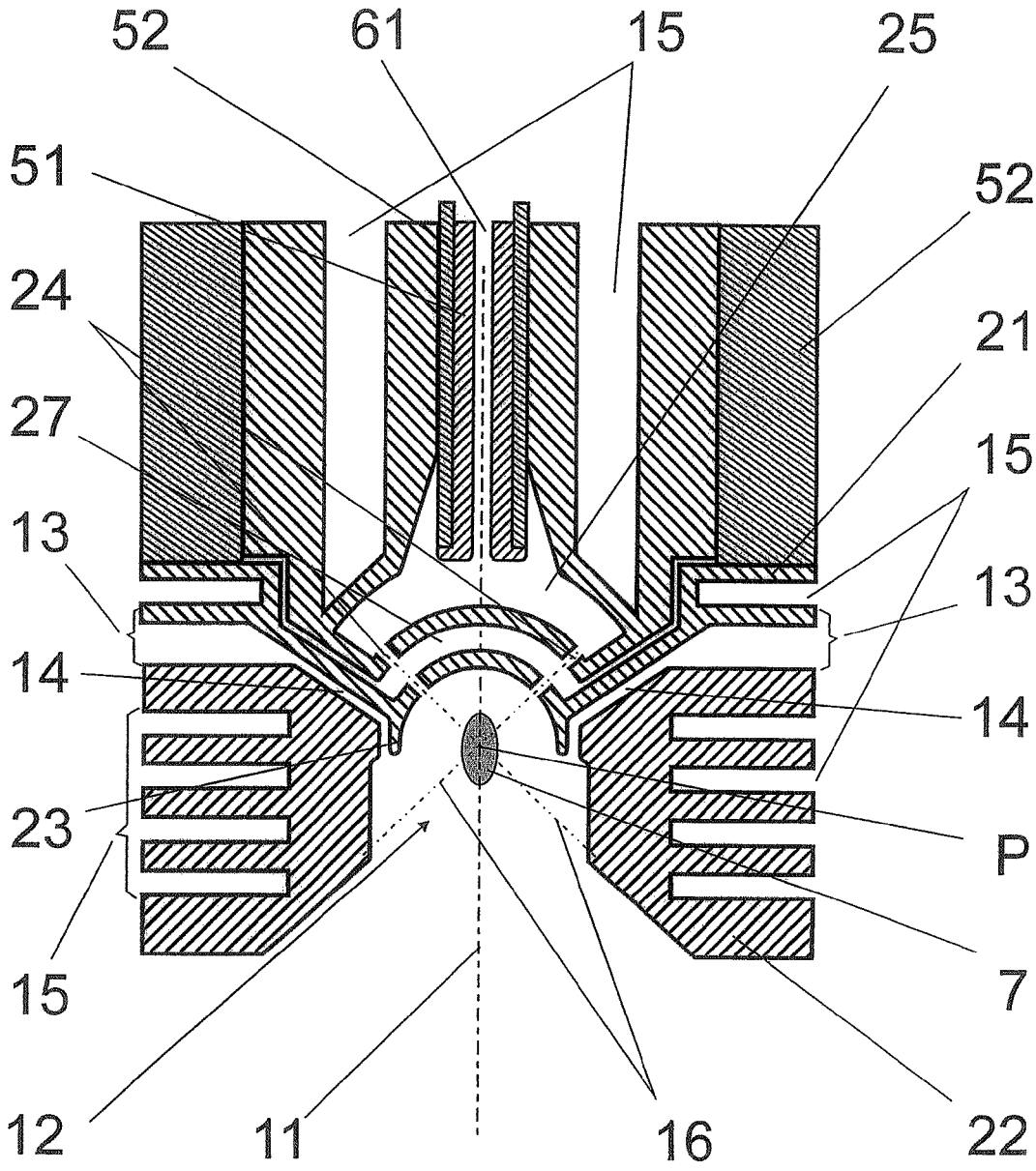
FIG. 9 shows a modification of FIG. 5 with an auxiliary electrode which is arranged inside the cathode and forms the cathode cavity and enables a separation of the electrodes for the pre-ionization of the main discharge electrodes, anode and cathode.

In FIG. 9, in contrast to FIG. 5, an additional auxiliary electrode 54 is arranged inside the cathode 21 in an enlarged cavity 25. Another cavity 27 which works in exactly the same way as in the cathode 21 in FIG. 4 is provided inside the auxiliary electrode 54. This arrangement has three different high-voltage potentials:

1. Pulse voltage between the pre-ionization electrode 51 and the auxiliary electrode 54 for generating the surface discharge 53 via the ceramic insulator 52.
2. Pulse voltage between the auxiliary electrode 54 and the cathode 21. This pulse voltage accelerates the electrons starting in the through-channels 24 of the auxiliary electrode 54 toward the through-channels 24 in the cathode 21.
3. Pulse high-voltage for the main discharge between the cathode 21 and anode 22. The accelerated electrons generate primary ionization channels 16 for the main discharge which face in direction of the surface of the anode 22 and intersect at a point P on the axis of symmetry 11 of the discharge chamber 12. The through-channels 24 in the auxiliary electrode 54 and cathode 21 can also be slit-shaped.

Figure 10:
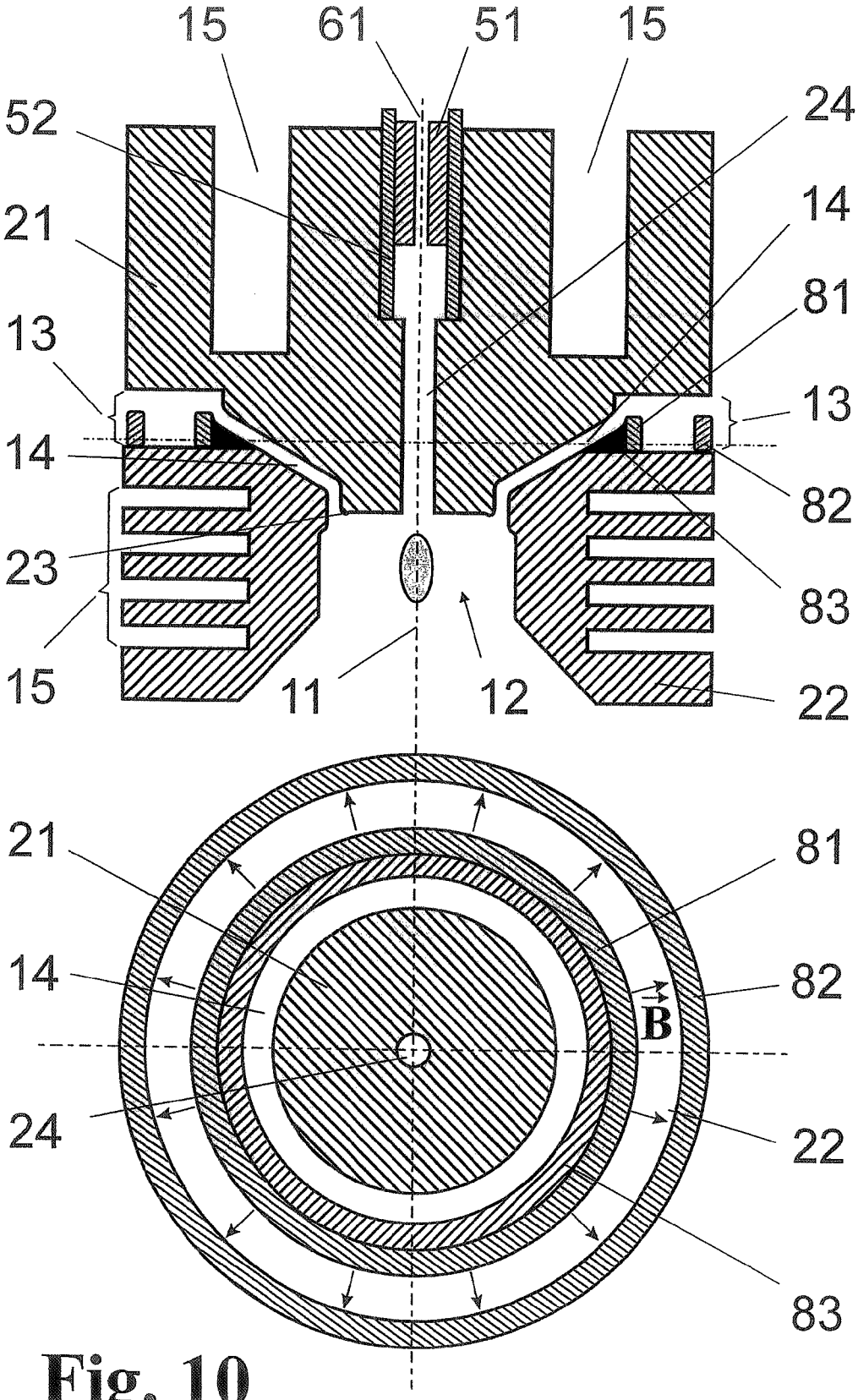
FIG. 10 shows a constructional variant in which the breakdown voltage is increased by providing a radially oriented magnetic field in the vacuum insulation area with a large interelectrode distance.
Figure 11:
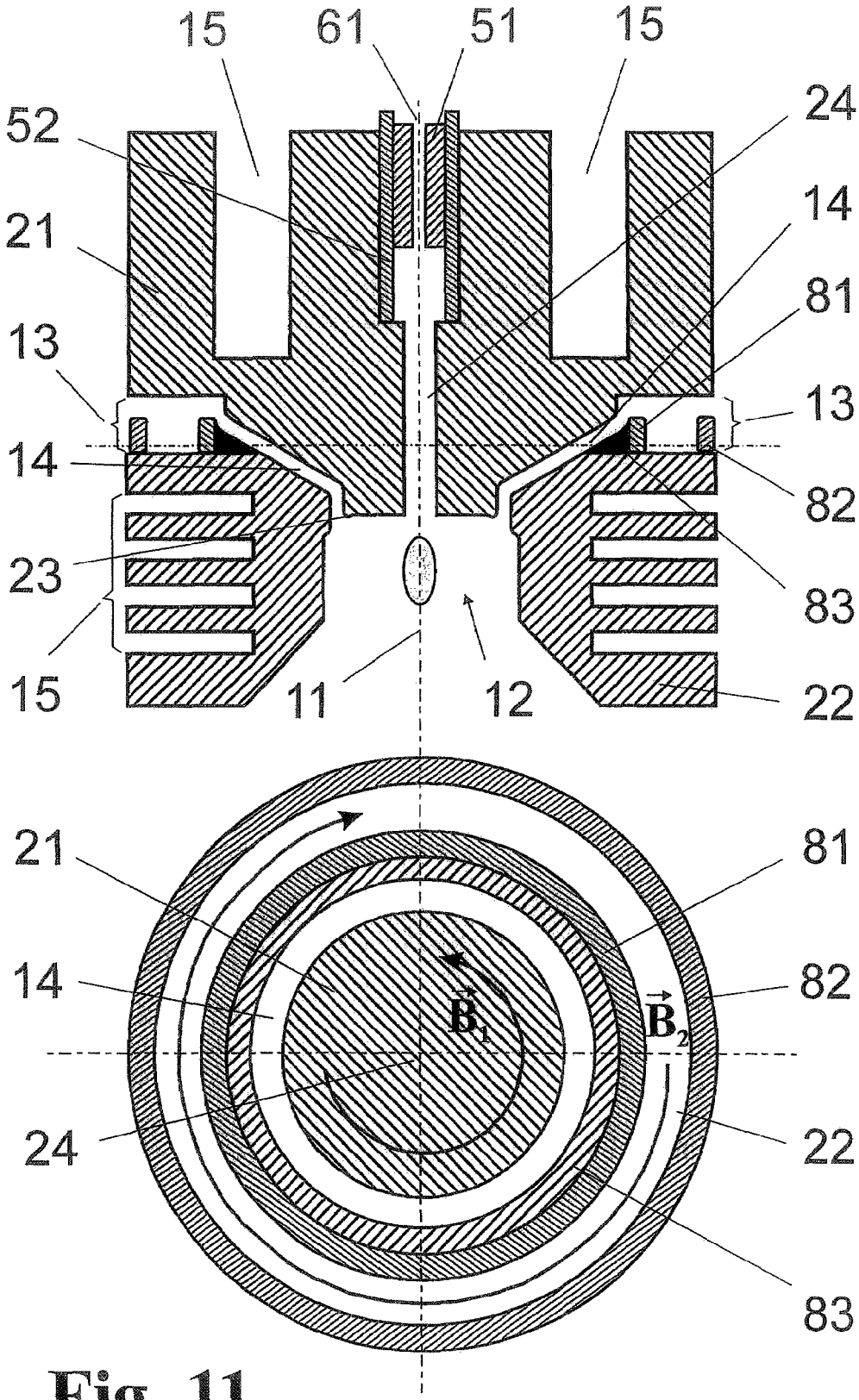
FIG. 11 shows a constructional variant in which the breakdown voltage is increased by arranging two oppositely located, circularly oriented magnetic fields in the vacuum insulation area with a large interelectrode distance.

FIGS. 10 and 11 show modifications of the arrangement shown in FIG. 3. At least one magnetic field having an orientation of the flux lines perpendicular to the direction of the electric field between the anode 21 and cathode 22 is additionally arranged in the vacuum insulation space 13. The function of the magnetic field is explained in the following.

If an ideal vacuum existed between the anode 22 and the cathode 21, there would be no problems with electric arcing in the vacuum insulation. The breakdown voltage between the cathode 21 and anode 22 is dependent on a product p·d (gas pressure p times interelectrode distance d), and the breakdown voltage drops as the p·d values increase in all of the examples discussed herein (left-hand branch of the Paschen curve).

Since a gas discharge source is additionally filled with gas (as work gas and/or as additional gas influx for debris mitigation), an effective p·d value is one in which the breakdown voltage decreases when gas pressure increases. However, for design-related reasons (e.g., because of the recipient connections for connecting to the vacuum pump 17), the increase in the p·d value cannot be compensated to an unlimited extent in the vacuum insulation space 13 (the area of the greatest interelectrode distance d) by reducing the interelectrode distance d. Initial experiments have shown that the limit of the dielectric strength is reached especially in the vacuum insulation space 13 under these conditions.

However, by installing magnetic fields $\vec{B}$ (electromagnets, permanent magnets of suitable material) in which the B-flux lines are perpendicular to the E-flux lines, the breakdown voltage for the present geometry (e.g., 5 mm interelectrode distance) and the existing work pressure of the gas (e.g., 15 Pa) can be increased by a factor of >5. This is because electrons exiting from the cathode 21 which accelerate the electric field between the anode 22 and cathode 21 are decreased due to the magnetic field $\vec{B}$ in such way that the acceleration path length of the electrons leading up to an interaction with a gas atom is sharply reduced in direction of the electric field. Therefore, the average kinetic energy of the electrons is comparatively low.

Studies has shown that B-fields with field strengths on the order of 1 T (Tesla) are sufficient. These field strengths can also be achieved by permanent magnets (e.g., NdFeB magnets). Magnetic fields should advantageously be arranged at the locations with the greatest p·d values, e.g., in the vacuum insulation space 13, that is, in areas with a large interelectrode distance or in the vicinity of gas inlet openings 61.

FIG. 10 shows a variant with two magnet rings 8, between which a magnetic field $\vec{B}$ is formed in radial direction to the axis of symmetry 11 of the discharge chamber 12 and of the entire electrode configuration. The magnetic field $\vec{B}$ extends substantially over the entire vacuum insulation space 13 in this example.

The areas around the inner and outer magnet rings 81 and 82 are not critical because the breakdown voltage in these locations is automatically increased due to the reduced distance d. However, it is useful to arrange a body 83 at the electrode (in this case, the anode 22) on the inner magnet ring 81 in order to prevent inhomogeneities in the electric field between the anode 22 and cathode 21 by adapting the interelectrode distance d from the transition area 14 to the magnet ring 81. Alternatively, the magnet rings 81 and 82 can also be arranged at the cathode 21. Electromagnets can also be used instead of permanent magnets.

In the construction according to FIG. 11, two magnet rings 81 and 82 are arranged at the anode 22 so as to have an identical effect with respect to increasing the dielectric strength, but with circular orientation of the magnetic flux lines. In this variant, two circular magnetic fields $\vec{B}_1$ and $\vec{B}_2$ which are oriented opposite to one another are formed inside the magnet ring 81 and 82, respectively. Magnetic field $\vec{B}_2$ is strengthened between the magnet rings 81 and 82 and, overall, is more homogeneous than in the radial shape shown in FIG. 10. The circular shape of field $\vec{B}_2$ also removes the charge carriers from the vacuum insulation space 13 more efficiently than with a radial magnetic field.

Figure 12:
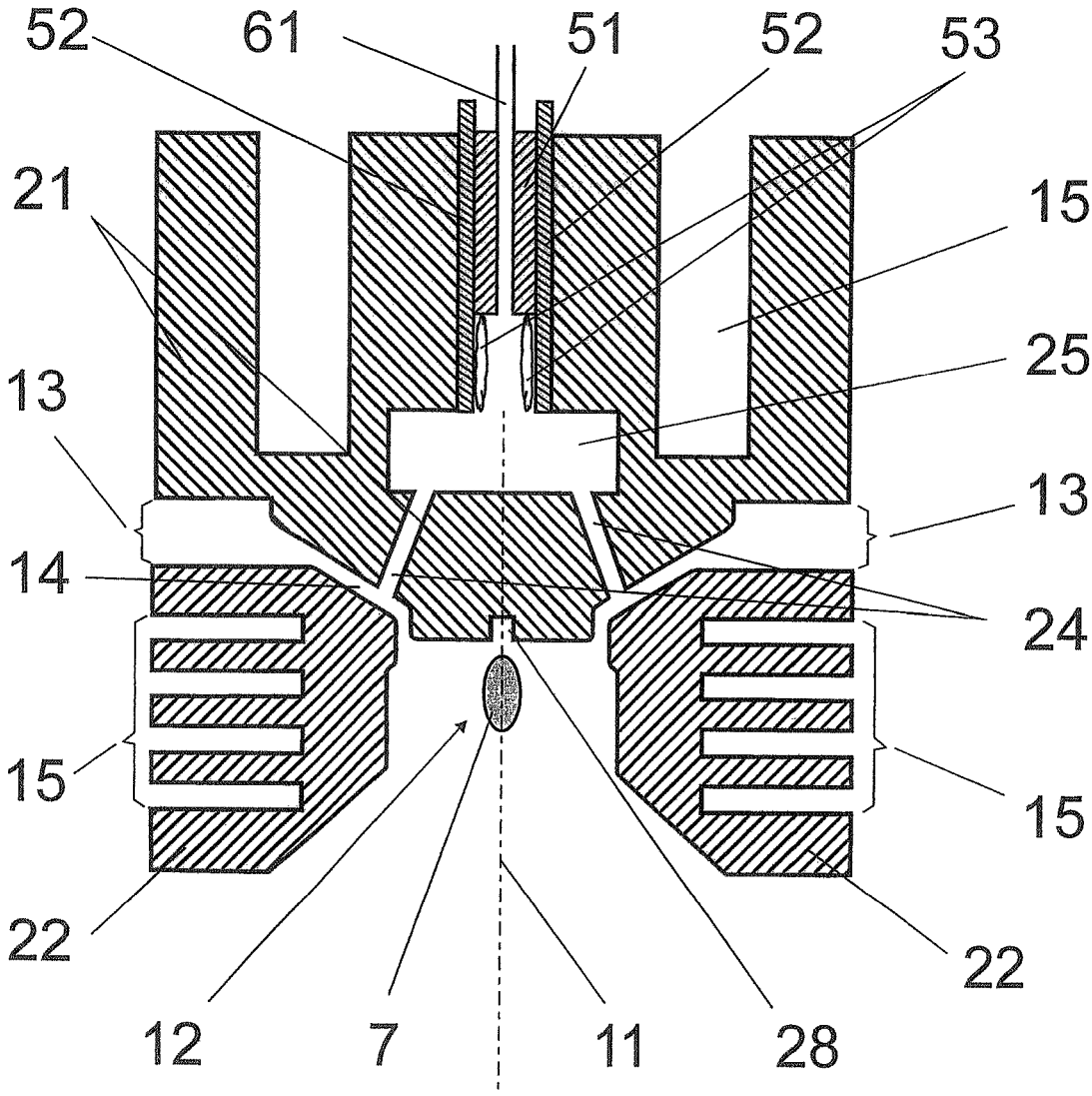
FIG. 12 shows another construction of the invention in which the narrow transition area of the vacuum insulation is used for introducing the primary ionization channels into the discharge chamber, wherein the through-channels of the pre-ionization unit are introduced in the transition area.
Figure 13:
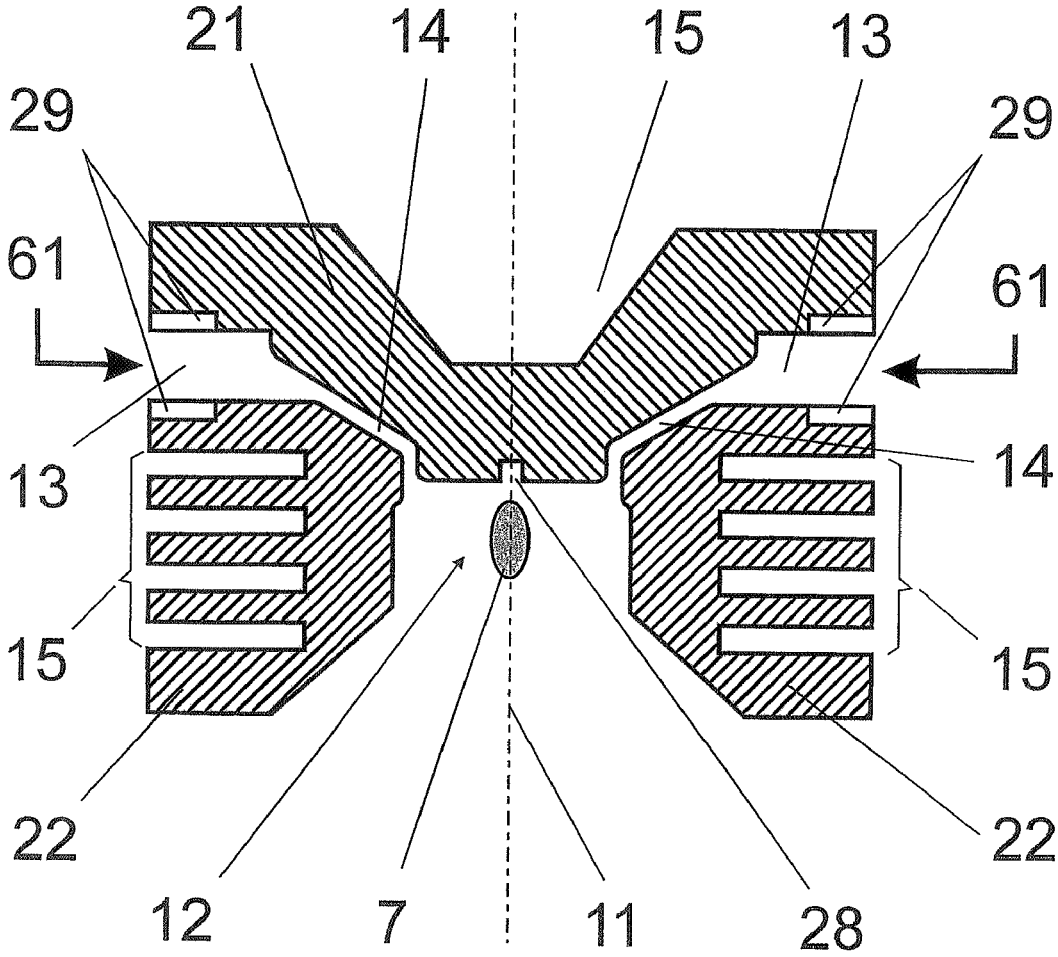
FIG. 13 shows a construction of the invention without pre-ionization in which the vacuum insulation space (with a large interelectrode distance) is expanded locally in a deliberate manner so as to effect a spontaneous ignition of the work gas flowing into it.

The constructional variants according to FIGS. 12 and 13 are characterized in that the ignition of the pre-plasma (generation of ionization channels 16) is carried out in the vacuum insulation space 13 and in the evacuated transition area 14 after applying the high-voltage main pulse to the cathode 21 and anode 22. As in all of the preceding examples, the vacuum insulation space 13 has a larger interelectrode distance d compared to the transition area 14 of the vacuum insulation between the discharge chamber 12 and vacuum insulation space 13.

In the construction shown in FIG. 12, the annular pre-discharge (as was described with reference to FIG. 3 to FIG. 6) is initiated by pre-ionization, and the pre-ionized gas is introduced into the transition area 14 between the vacuum insulation space 13 and the discharge chamber 12 by means of the through-channels 24. The vacuum-insulated transition area 14 which, in this example, takes over the function of shaping the primary insulation channels 16 for the main discharge is used for igniting the main discharge. In this case also, the conducting annular zone that is formed in this way contracts due to magnetic forces during the main current pulse in direction of the axis of symmetry 11 of the discharge space 12 to form the dense, hot plasma 7.

According to FIG. 13, the gas inlet 61 for the work gas is connected directly from the outside to the wide vacuum insulation space 13. Since the vacuum chamber 1 is gas-tight and is evacuated in such a way that the gas discharge is carried out on the left-hand side of the Paschen curve, the discharge starts in the areas with the greater product of gas pressure p and interelectrode distance d when—as is the case in FIG. 13—there is no additional discharge initiation (e.g., through pre-ionization). The gas pressure is adjusted in such a way that a spontaneous ignition can be carried out only in the annular vacuum insulation space 13 for voltages above a defined value.

In order to achieve a multiple-channel ignition by generating local, radially directed primary ionization channels 16, additional, oppositely located grooves 29 are provided in the cathode 21 and anode 22. These grooves 29 cause a further increase locally in the product of gas pressure p and interelectrode distance d at suitable positions in the vacuum insulation space 13 so as to enable a spontaneous ignition of the plasma especially in these grooves 29 at voltages above a defined value.

The current ring or local ionization channels 16 in the grooves 29 formed in the vacuum insulation space 13 in this way are contracted due to the magnetic forces of the main discharge current radially in direction of the axis of symmetry 11 of the discharge chamber 12 through the conical transition 14 to the discharge space 12. A conductive zone which is formed in this way and which occurs along the axis of symmetry 11 below the pocket hole 28 at the cathode end is then heated by the main current pulse to form the plasma 7 emitting EUV radiation.

While the foregoing description and drawings represent the present invention, it will be obvious to those skilled in the art that various changes may be made therein without departing from the true spirit and scope of the present invention.

| Reference Numbers | |
|---|---|
| 1 | vacuum chamber |
| 11 | axis of symmetry |
| 12 | discharge chamber |
| 13 | vacuum insulation space |
| 14 | (evacuated) transition area |
| 15 | cooling channels |
| 16 | primary (electrically conducting) ionization channels |
| 17 | vacuum pump |
| 2 | electrodes |
| 21 | cathode |
| 22 | anode |
| 23 | rounded electrode collar |
| 24 | through-channel |
| 25 | cavity |
| 26 | annular gap |
| 27 | additional cavity |
| 28 | pocket hole |

-continued

| Reference Numbers | |
|---|---|
| 29 | grooves |
| 3 | main pulse generator |
| 4 | pre-ionization pulse generator |
| 5 | pre-ionization unit |
| 51 | pre-ionization electrode |
| 52 | (tubular) insulator |
| 53 | surface discharge |
| 54 | auxiliary electrode |
| 55, 56 | inner, outer insulator |
| 6 | gas supply unit |
| 61 | gas inlet |
| 7 | plasma |
| 8 | magnet rings |
| 81 | inner magnet ring |
| 82 | outer magnet ring |
| 83 | body |
| $\mathbb{B}$ | magnetic field |
| $\mathbb{B}_1$, $\mathbb{B}_2$ | (oppositely oriented) magnetic fields |
| d | interelectrode distance |
| p | gas pressure |
| P | common point (intersection of the ionization channels) |
| S | web |

What is claimed is:

1. In an arrangement for the generation of EUV radiation based on a gas discharge plasma in which a cathode and an anode are arranged in a cylindrically symmetric manner and a pre-ionized work gas is supplied to the cathode end, comprising:

an insulation areas being exclusively provided as a suitably shaped annular vacuum gap that is formed and sized depending on the product of gas pressure (p) and interelectrode distance (d) of the cathode and anode between surfaces that face one another outside a desired discharge region, in which plasma is generated for insulating the cathode and anode from one another for reliable suppression of electron arcing.

2. The arrangement according to claim 1, wherein a device for the pre-ionization of the work gas is provided inside the centrally arranged cathode.

3. The arrangement according to claim 2, wherein the anode is a ring electrode enclosing at least the cathode end with a close interelectrode distance (d) and forming a discharge chamber.

4. The arrangement according to claim 3, wherein a pre-ionization electrode with a projecting tubular insulator is arranged in a centrally symmetric manner inside the cathode and opens into a cavity of the cathode for pre-ionization of the work gas, wherein a surface sliding discharge can be generated at the insulator by a pre-ionization pulse between the pre-ionization electrode and the cathode so that the work gas which is ionized in this way flows out of the cavity via at least one through-channel at the cathode end into the discharge chamber, where it is converted into dense, hot plasma by a main discharge pulse.

5. The arrangement according to claim 4, wherein a through-channel is arranged coaxially and centrally.

6. The arrangement according to claim 4, wherein a plurality of uniformly distributed through-channels are directed along an outer conical surface concentrically through a common point on the axis of symmetry to an inner surface of the anode.

7. The arrangement according to claim 6, wherein the through-channels degenerate to form an annular gap.

8. The arrangement according to claim 4, wherein the cathode is provided at its end with a rounded electrode collar which projects into the interior of the anode that circles the discharge chamber, wherein the vacuum insulation areas located between the anode and cathode are protected against debris particles from the plasma and against electrode consumption by the electrode collar.

9. The arrangement according to claim 8, wherein the cathode end inside the electrode collar has a concave curvature and is the location where the dense, hot plasma is formed.

10. The arrangement according to claim 9, wherein a pocket hole is incorporated in the center of the concave curvature of the cathode.

11. The arrangement according to claim 4, wherein the cathode has a small cavity and long through-channels, wherein the through-channels are arranged coaxially and are shaped in such a way that, at the cathode end in the discharge chamber, primary electrically conducting ionization channels are directed through a common point on the axis of symmetry of the discharge chamber to a surface of the anode.

12. The arrangement according to claim 4, wherein the cathode has a large cavity and short through-channels, wherein the cavity extends into the vicinity of a concave cathode end, and the through-channels are arranged in such a way that primary electrically conducting ionization channels are directed from the ionized work gas flowing into the discharge chamber, through a common point on the axis of symmetry of the discharge chamber, to a surface of the anode.

13. The arrangement according to claim 4, wherein the surface discharge provided for the pre-ionization of the work gas is provided at the inner side of the insulator, and the pre-ionization electrode is shorter than the tubular insulator and is arranged with a central gas inlet inside the tubular insulator.

14. The arrangement according to claim 4, wherein the surface discharge used for the pre-ionization of the work gas is provided on the outer side of the insulator, and the pre-ionization electrode projecting into the cavity of the cathode is arranged with a central gas inlet and a tubular insulator located on the outer side.

15. The arrangement according to claim 14, wherein the cavity of the cathode is expanded in width and, in the shape of a spherical hood, is provided with short through-channels over a concave cathode end, wherein the through-channels are directed through a common point to the inner surface of the anode.

16. The arrangement according to claim 14, wherein the cavity of the cathode is shaped so as to taper conically toward the cathode end and is provided directly with the gas inlet and has a circular opening at the concave cathode end, wherein the pre-ionization electrode is inserted coaxially into this opening so that an annular gap is left open relative to the discharge chamber through which the work gas is directed in primary electrically conducting ionization channels in the shape of an outer cone surface through a common point on the axis of symmetry of the discharge chamber to an inner surface of the anode.

17. The arrangement according to claim 16, wherein the pre-ionization electrode has a pocket hole at its surface facing the discharge chamber in the axis of symmetry and has its own cooling channels.

18. The arrangement according to claim 14, wherein the cavity of the cathode tapers conically toward the cathode end and has a circular opening at the concave cathode end, the pre-ionization electrode being snugly inserted therein with inner and outer insulators, wherein the pre-ionization electrode has a plurality of gas inlets which are directed to the surface of the anode as through-channels through the inner and outer insulators via a common point on the axis of symmetry.

19. The arrangement according to claim 14, wherein an auxiliary electrode which is insulated from the cathode is inserted into the cavity of the cathode, wherein the auxiliary electrode has the cavity provided for the pre-ionization of the work gas, and the pre-ionization electrode with outer insulator is arranged so as to project into the cavity, and in that at least one corresponding through-channel is provided in the cathode and auxiliary electrode for the exit of the pre-ionized work gas into the discharge chamber.

20. The arrangement according to claim 19, wherein a plurality of through-channels are arranged in the auxiliary electrode and the cathode along an outer conical surface in order to form primary ionization channels from the cavity into the discharge chamber, wherein the through-channels are directed to an inner surface of the anode through a common point on the axis of symmetry of the discharge chamber.

21. The arrangement according to claim 19, wherein the auxiliary electrode is insulated from the cathode end by another cavity in which a voltage pulse for accelerating the ionized work gas can be applied additionally between the auxiliary electrode and the cathode.

22. The arrangement according to claim 1, wherein means for generating a magnetic field ($\vec{B}$;$\vec{B}_1$,$\vec{B}_2$) are provided in order to increase the dielectric strength of the vacuum insulation, particularly with larger interelectrode distances (d) in the vacuum insulation space, wherein the flux lines of the magnetic field are oriented orthogonal to those of the electric field between the anode and cathode.

23. The arrangement according to claim 22, wherein concentric magnet rings are arranged on the inner side and outer side in the vacuum insulation space, the magnetic field being formed in radial direction therebetween, wherein a body is arranged toward the transition area in order to prevent inhomogeneities in the electric field between the anode and cathode.

24. The arrangement according to claim 22, wherein concentric magnet rings are arranged on the inner side and the outer side in the vacuum insulation space, around which are formed two opposed, circularly extending magnetic fields ($\vec{B}_1$,$\vec{B}_2$), wherein a body is arranged toward the transition area to prevent inhomogeneities in the electric field between the anode and cathode in the transition area.

25. The arrangement according to claim 22, wherein concentric magnet rings comprising a plurality of individual permanent magnets are arranged for generating the magnetic fields ($\vec{B}$;$\vec{B}_1$,$\vec{B}_2$).

26. The arrangement according to claim 25, wherein the concentric magnet rings comprise a plurality of individual NdFeB magnets.

27. The arrangement according to claim 22, wherein concentric magnet rings comprising a plurality of individual electromagnets are arranged for generating the magnetic fields.

28. The arrangement according to claim 1, wherein a pre-ionization unit has through-channels to a gap-shaped transition area between the vacuum insulation space and discharge chamber, wherein the work gas that is pre-ionized in this way is introduced into the discharge chamber through the transition area of the vacuum insulation between the cathode and anode and is contracted by the main current pulse to form the hot, dense plasma.

29. The arrangement according to claim 1, wherein the gas inlet is arranged in an outer vacuum insulation space with a large interelectrode distance (d) between the cathode and anode, and the gas pressure (p) and interelectrode distance (d) are adjusted in such a way that the product of gas pressure (p) and interelectrode distance (d) for a work gas that is used exceeds a defined value in order to achieve a spontaneous ignition of the work gas in the annular vacuum insulation space.

30. The arrangement according to claim 29, wherein grooves or similar structures are incorporated in the outer vacuum insulation space in at least one of the oppositely located electrode surfaces of the cathode and anode to increase the interelectrode distance for the purpose of a local increase in the product of gas pressure (p) and interelectrode distance (d) and to initiate the spontaneous ignition in a plurality of primary ionization channels.

31. The arrangement according to claim 29, wherein the electrodes for the plasma-generating gas discharge, cathode and anode, are outfitted with cooling channels for cooling.

32. The arrangement according to claim 31, wherein additional auxiliary electrodes provided for pre-ionization of the work gas are provided with cooling channels.

33. The arrangement according to claim 21, wherein deionized water is used as coolant.

34. The arrangement according to claim 32,erein deionized water is used as coolant.

35. arrangement according to claim 1, wherein xenon, lithium vapor or tin vapor, or gaseous tin compounds are used as work gas.

* * * * *